US005577372A

United States Patent [19]

Grönberg

[11] Patent Number: 5,577,372

[45] Date of Patent: Nov. 26, 1996

[54] METHOD FOR FITTING A SADDLE ON THE BACK OF A HORSE

[76] Inventor: Pauli Grönberg, Koskitie 11, FIN-04300 Tuusula, Finland

[21] Appl. No.: 302,812

[22] PCT Filed: Mar. 7, 1993

[86] PCT No.: PCT/FI93/00357

§ 371 Date: Sep. 13, 1994

§ 102(e) Date: Sep. 13, 1994

[87] PCT Pub. No.: WO94/18115

PCT Pub. Date: Aug. 18, 1994

[30] Foreign Application Priority Data

Feb. 1, 1993 [FI] Finland ..... 930437

[51] Int. Cl.[6] ..... B68C 1/12

[52] U.S. Cl. ..... 54/66

[58] Field of Search ..... 54/44.5, 44.6, 54/66

[56] References Cited

U.S. PATENT DOCUMENTS

| | | | |
|---|---|---|---|
| 852,593 | 5/1907 | Benbow | 54/66 X |
| 3,343,338 | 9/1967 | Stübben | 54/66 X |
| 5,119,618 | 6/1992 | Streck | 54/66 |
| 5,175,986 | 1/1993 | Farley | 54/66 X |

*Primary Examiner*—Robert P. Swiatek
*Attorney, Agent, or Firm*—Abelman, Frayne & Schwab

[57] ABSTRACT

A method for adapting a saddle (2) onto the back of a horse (1), in which method paddings (5') are adapted to fit between the saddle frame and the horse's back. The invention is implemented so that, in conjunction with the positioning of the saddle (2), substantially undeformable cushion paddings (5') conformant to the shape of the back of the horse are formed by a process of filling casting moulds (5) placed between the saddle frame and the back of the horse (1) or by an equivalent process.

6 Claims, 1 Drawing Sheet

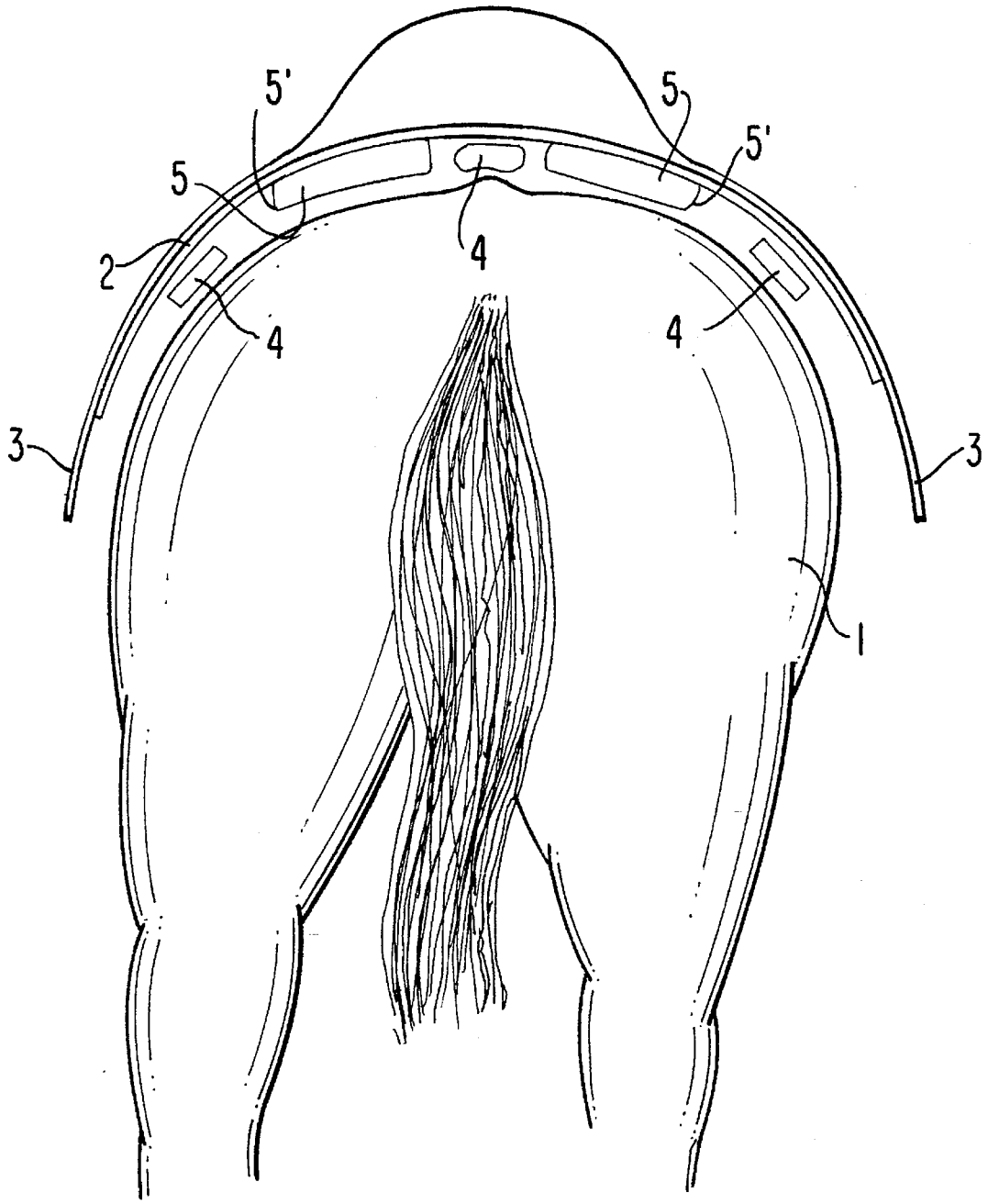
5'
5
5
5'
4
2
4
4
3
3
1

METHOD FOR FITTING A SADDLE ON THE BACK OF A HORSE

The present invention is related to a method for fitting a saddle on the back of a horse, said method availing of paddings adapted between the saddle frame and the back of the horse.

For the state of the art, reference is made to U.S. Pat. No. 5,119,618 and DE application publication 41 00 027 A1.

When placing a saddle on the back of a horse, it is essential that the saddle not tilt to either side or forward/backward. Furthermore, it is important that the saddle not rock longitudinally. Such requirements are attempted to be satisfied by using different kinds of cushion paddings, which are adapted between the horse's back and the saddle frame to places considered functional.

However, the backs of horses have individual shapes both in the transverse and longitudinal direction of the back. Moreover, as the above-mentioned cushion paddings chiefly are factory-made and thus of standard shape and size, such cushion paddings are poorly suited to satisfy the requirements listed above. Furthermore, these ready-made cushion paddings generally comply unsatisfactorily with the shape of the back of the horse, which may cause back pain and even injure the back to the horse. Such an outcome is difficult to prevent, since the poor compatibility of the cushion paddings is typically noted only after the horse's back has become sore. A further problem in the correct placement of the cushion paddings is caused by the saddle which prevents visual and tactile inspection where to add or remove padding. Also the mounting of the rider on the saddle changes its position and complicates the fitting of the paddings.

Besides factory-made paddings, also horsehair and rags for instance are employed for said purpose. These materials have, however, the same basic deficiencies as factory-made cushion paddings.

It is an object of the present invention to achieve a method capable of overcoming the above-described problems and making it possible to correctly position the saddle for each horse individually in a manner avoiding incorrect loading of the horse's back. The method according to the invention is characterized in that, in conjunction with the positioning of the saddle, substantially undeformable cushion paddings conformant to the shape of the back of the horse are made by casting or an equivalent process between the saddle frame and the back of the horse.

An embodiment of the method according to the invention is characterized in that, prior to the casting process, inflatable spacer elements and a casting mould or moulds are placed between the saddle frame and the back of the horse, the spacer elements are partially inflated, the girth straps of the saddle are tightened, the inflation pressure of the spacer elements is increased until the saddle is with the help of the spacer elements correctly positioned and sufficiently tightened to a load corresponding to the weight of the rider, after which the casting moulds are filled with an elastically resilient material such as, for instance, foamed plastic, foamed rubber or equivalent.

Another embodiment according to the invention is characterized in that the number of the spacer elements employed is three, one of which being placed longitudinally above the spine of the horse and the other two elements being placed parallel to the first on the horse's flanks, to both sides of the horse's spine.

A further another method according to the invention is characterized in that two casting moulds are employed, whereby each of the spaces between the spacer elements has one mould placed longitudinally relative to the horse's spine.

The invention makes it possible to adapt the saddle on any horse in an individually optimal fashion avoiding incorrect loading of the horse's back. Furthermore, the undeformable padding panels made according to the method can later be used at any time when the rider mounts on said horse.

In the following the invention is described in greater detail with reference to the annexed drawing, wherein the diagram shows a cross-section of a saddle placed on the horse's back, together with the spacer elements and casting moulds employed in the method according to the invention.

Reference numeral 1 denotes a horse, and correspondingly, reference numeral 2 denotes a saddle or a part thereof, with girth straps 3 attached to it. At the same time the saddle 2 is placed on the horse's back, also spacer elements 4 are adapted between the horse's back and the saddle. The spacer elements are preferably oblong, for instance, tubular elements inflatable with compressed air, for instance. The exemplifying embodiment shown in the drawing has three spacer elements, one of which being placed above the spine of the horse and the other two elements being placed parallel to the first on the horse's flanks, to both sides of the horse's spine, and all elements are aligned longitudinally with respect to the horse's spine. Essentially simultaneously with the placing of the spacer elements, the spaces between the spacer elements, delineated by the saddle and the horse's back, are provided with two casting moulds 5, which are advantageously longitudinally aligned with respect to the horse's spine, said moulds being bags or similar elements of appropriately soft material. During their placing the casting moulds are at least essentially empty.

Initially the spacer elements are inflated with a low pressure, then the saddle is tightly strapped with the help of the girth straps 3. Next, the inflation pressure of the spacer elements is elevated until the saddle is tightly fixed to an optimally correct position, that is, transversely and longitudinally straight and as immobile as possible. The spacer elements are substantially inflated by a pressure, which produces tightening to a load essentially corresponding to the pressure imposed by the weight of the rider via the saddle onto the horse's back.

After the saddle is correctly positioned and properly tightened with the help of the spacer elements, the casting moulds 5 are pressure-filled with an elastically resilient material. The elastically resilient material can be such as, for instance, a porous material advantageously foamed plastic, foamed rubber or equivalent material which is elastic and causes minimum inconvenience on the horse's back. The material is fed into the casting mould in two-component form, whereby the mutual reaction of these components gives in a conventional manner the required solid, yet elastic material.

After the casting moulds are filled, and the material components contained therein have reacted and set in the final form, the inflation pressure of the spacer elements 4 can be relieved and the elements removed. Thus the cushion paddings 5' have assumed their final form and they can thereinafter be employed as a panel between this specific horse and a saddle. The cushion paddings 5' are advantageously fixed by sewing or other suitable fashion to the saddle frame 2, thereby assuring in all conditions their correct alignment against the horse's back. Fixing to the saddle also prevents loss of the cushion paddings during storage.

For a person versed in the art it is obvious that the invention is not limited to the exemplifying embodiments described above, but rather can be varied within the scope of the annexed claims. Therefore, the feed of the inflating air or other suitable medium into the spacer elements is easily solved by a skilled person although not explicitly shown in the description above or the annexed drawing. The same reasoning also applies to the use of the casting moulds.

I claim:

1. A method for adapting a saddle (2) onto the back of a horse (1), in which method paddings (5') are adapted to fit between the saddle frame and the horse's back, characterized in that, in conjunction with the positioning of the saddle (2), said paddings (5') comprise substantially undeformable cushion paddings (5') conformant to the shape of the back of the horse (1) which are formed by a process of filling casting moulds (5) placed between the saddle frame and the back of the horse.

2. A method as defined in claim 1, characterized in that, prior to the process of filling casting moulds (5), inflatable spacer elements (4) and a casting mould (5) or moulds are placed between the frame of the saddle (2) and the back of the horse, the spacer elements are partially inflated, the girth straps (3) of the saddle are tightened, the inflation pressure of the spacer elements is increased until the saddle is correctly positioned and sufficiently tightened to a load essentially corresponding to the weight of the rider, after which the casting moulds (5) are filled with an elastically resilient material such as, for instance, foamed plastic, foamed rubber, or equivalent.

3. A method as defined in claim 2, characterized in that the number of the spacer elements (4) employed is three, one being placed longitudinally above the spine of the horse (1) and the other two being placed parallel to the first on the horse's flanks, to both sides of the horse's spine.

4. A method as defined in claim 3, characterized in that two casting moulds (5) are employed, whereby each of the spaces between the spacer elements 4) has one mould placed longitudinally relative to the horse's spine.

5. A method as defined in claim 2 characterized in that after the casting moulds (5) are filled, the inflation pressure of the spacer elements (4) is relieved and the spacer elements are removed.

6. A method as defined in claim 2, characterized in that the completed cushion paddings (5') formed by the process of filling casting moulds (5) are advantageously fixed by sewing or other suitable fashion to the saddle frame (2).

* * * * *